United States Patent [19]

Oxé et al.

[11] 3,983,061

[45] Sept. 28, 1976

[54] PROCESS FOR THE PERMANENT FINISHING OF FIBER MATERIALS

[75] Inventors: Josef Oxé, Arlesheim; Rudolf Keller, Riehen, both of Switzerland

[73] Assignee: Ciba-Geigy Corporation, Ardsley, N.Y.

[22] Filed: June 4, 1974

[21] Appl. No.: 476,167

Related U.S. Application Data

[62] Division of Ser. No. 226,511, Feb. 15, 1972, Pat. No. 3,835,148.

[52] U.S. Cl. ..... 260/29.6 MN; 260/29.6 ME; 427/390; 8/76; 106/2; 252/8.8

[51] Int. Cl.[2] ..... C08F 45/44

[58] Field of Search ..... 117/139.5; 260/29.6 MN, 260/30.2, 93.7, 29.6 YA, DIG. 19, DIG. 21, DIG. 45–48 N; 8/115.5, 115.6, 76; 427/390; 106/2; 252/8.8

[56] References Cited

UNITED STATES PATENTS

| | | | |
|---|---|---|---|
| 3,138,610 | 6/1964 | Buc et al. | 260/29.6 MN |
| 3,210,312 | 4/1965 | Rosenberg et al. | 260/30.2 |
| 3,361,718 | 1/1968 | Fujimoto et al. | 260/29.6 MN |
| 3,701,765 | 10/1972 | Magosh et al. | 260/93.7 |
| 3,749,691 | 5/1973 | Kandathl | 260/29.6 YA |

FOREIGN PATENTS OR APPLICATIONS

| | | | |
|---|---|---|---|
| 1,089,810 | 11/1967 | United Kingdom | 260/DIG. 19 |
| 1,242,537 | 8/1971 | United Kingdom | 260/29.6 MN |

*Primary Examiner*—Michael R. Lusignan
*Attorney, Agent, or Firm*—Joseph G. Kolodny; Edward McC. Roberts; Prabodh I. Almaula

[57] ABSTRACT

Disclosed is an aqueous acid solution or suspension of a preparation as well as the production thereof for the permanent finishing of fiber materials, especially dyed carpets, to render them antistatic, dirt-repellent and, optionally, antimicrobial, which aqueous preparation contains:

a. 10 to 20 per cent by weight of at least one antistatic agent, b. 3 to 35 per cent by weight of a stabilized, aqueous non-film-forming dispersion of polystyrene, c. 1 to 6 per cent by weight of at least one acid, especially o-phosphoric acid, and d. 0 to 5 per cent by weight of further components, such as an antimicrobic agent and a solubility-promoting agent.

9 Claims, No Drawings

PROCESS FOR THE PERMANENT FINISHING OF FIBER MATERIALS

This application is a division of U.S. application Ser. No. 226,511, filed Feb. 15, 1972, now U.S. Pat. No. 3,835,148, issued on Sept. 10, 1974.

The invention relates to a process for the permanent finishing of fibre materials to render them antistatic and dirt-repellent and, optionally, antimicrobial; to the finishing preparation; as well as to the fibre material, as industrial product, finished by application of the said process.

The method is known of rendering fibre materials solely antistatic or solely dirt-repellent. Textile materials possessing a good antistatic finish, however, frequently display a greater tendency to become stained or the dyeings produced thereon have an inferior fastness to rubbing; and the dyeings on materials of which the finish is effectively dirt-repellent exhibit very often a tendency to vary in shade. It is also possible to impart to fibre materials simultaneously an antistatic and dirt-repellent finish; the treatment of the materials at temperatures of over 100°C required to obtain these effects, however, leads in many cases to an appreciable impairment of the fastness to rubbing, and/or to a loss of the acquired finishing effects. The combination of specifically favourably acting components does not, contrary to expectation, result in optimum multiple finishing effects; and fibre material treated in such a manner frequently has, moreover, disadvantages in that, for example, the handle of the material is unfavourably affected, and the dyeing thereof suffers a dulling effect or displays a variation in shade.

A single-bath process has now been found which makes possible, in a surprising manner, the permanent finishing of fibre materials, preferably dyed textile fibres, e.g. dyed textile floor-coverings, so that the treated material is rendered simultaneously permanently antistatic and dirt-repellent and, optionally, antimicrobial, the material possessing a completely soft handle, the said effects being obtained without appreciable impairment of the fastness to rubbing of the dyeing. The term 'permanent' is meant to signify that the material treated according to the invention retains its valuable properties even after a prolonged period of wear and tear.

The process according to the invention is characterised in that the fibre material is treated with an aqueous solution or dispersion containing:

a. at least one antistatic agent, b. a stabilised, aqueous, preferably 20 to 60 per cent, especially 40 per cent, non-film-forming dispersion of polystyrene or of a styrene copolymerisate, preferably polystyrene, c. at least one acid, and d. optionally further constituents, the said treatment being performed in the acid pH-range.

Particularly favourable results with respect to the above-mentioned effects are obtained by the use in the process according to the invention of compounds, or mixtures of compounds according to (a), of the following formulae I to III as antistatic agents:

Compounds of formula I:

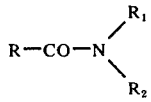

(I)

wherein

R represents an alkyl radical having 8 to 22, particularly, 14 to 18, carbon atoms, $R_1$ preferably represents hydrogen, or an optionally substituted alkyl group, and $R_2$ represents an optionally substituted alkyl group; or wherein $R_1$ and $R_2$ form together with the nitrogen atom a 5- or 6-membered heterocyclic ring, which can contain further hetero atoms, and can be optionally further substituted by R; or quaternary compounds thereof.

As a substituted alkyl group, $R_1$ and $R_2$ represent, for example, a hydroxyalkyl radical; in particular, they each represent the hydroxyethyl group, an alkyl radical substituted by water-solubilising groups, such as sulphonic acid groups and/or carboxylic acid groups, or an aminoalkylalkoxy or aminoalkyl radical, of which the amino group can be mono- or disubstituted. Mentioned as substituents of these amino groups are, for example, the following: hydroxyalkyl groups such as the hydroxyethyl or hydroxy-propyl groups; alkylaminoalkyl groups substituted with monovalent groups, e.g. with the cyano group; R—CO— or R—CONH-alkoxyalkyl groups wherein R represents an alkyl radical having 8 to 22 carbon atoms; also substituents in which the nitrogen atom of the amino group is a constituent of a heterocyclic 5- or 6-membered ring, particularly one containing further nitrogen atoms, e.g. the 2-stearyl-1,2-imidazole group.

Preferred compounds of formula I are, in particular, the following:

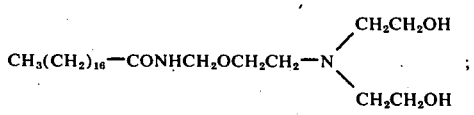

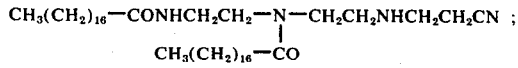

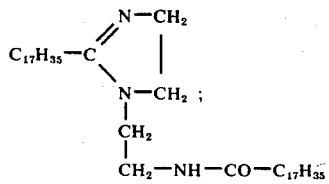

-continued

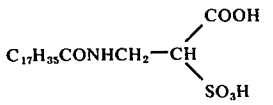

;

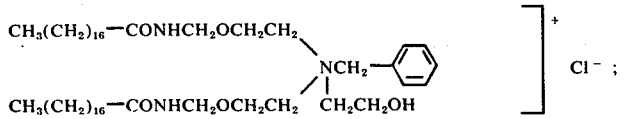

;

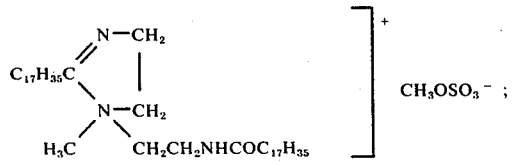

or

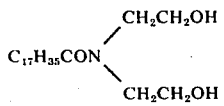

as well as mixtures of compounds of the formulae: $C_{17}H_{35}CONHCH_2CH_2OH$ and

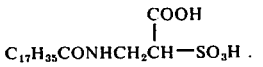

Compounds of formula II:

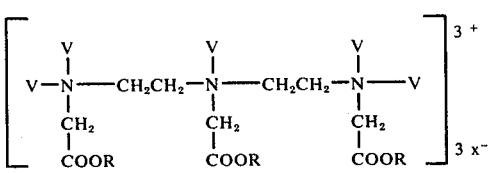

(II)

wherein

V represents a lower alkyl radical,

R represents an alkyl radical having 8 to 22 carbon atoms, and x represents an anion;

especially a compound of the formula:

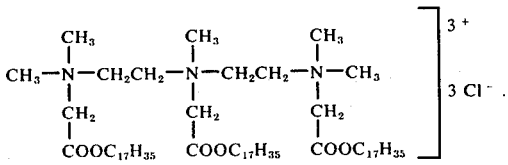

Here and in the following, the term "lower" signifies, in connection with alkyl groups, radicals having, in general, not more than 4 carbon atoms.

A polyglycol ether having a molecular weight of about 300 to 6,000, preferably 400 to 600, or a polyglycol ether of formula III:

$$Z - (CH_2CH_2O)_x - H \qquad \text{(III)}$$

wherein Z represents the radical of an aliphatic alcohol or amine, or of an aliphatic carboxylic acid having 8 to 22 carbon atoms, or of an alkylphenol with an alkyl radical having 8 to 12 carbon atoms, and $x$ represents the numbers 5 to 100.

Preferred polyglycol ethers are, in particular, the following:

$$C_{17}H_{35}-O-(CH_2CH_2O)_{30}-H$$

$$C_{18}H_{37}-O-(CH_2CH_2O)_{18}-H$$

and

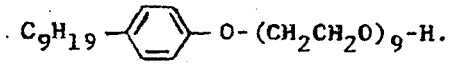

For the obtainment of permanent antistatic and dirt-repellent effects, a mixture of two or more of the stated compounds has proved particularly advantageous, especially a mixture of the compounds:

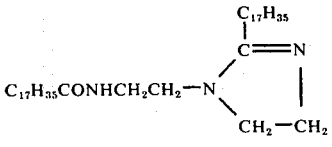

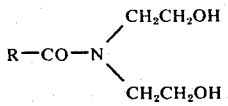

wherein R represents an alkyl radical having 14 to 18 carbon atoms, and a polyglycol ether of the formula:

$C_{18}H_{37}-O-(CH_2CH_2O)_{18}-H$ or

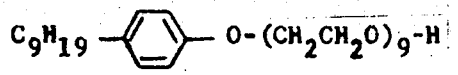

Suitable acids usable according to the invention are both inorganic and organic, monobasic and polybasic acids, or mixtures thereof. Examples of inorganic acids are: hydrochloric acid, hydrobromic acid, nitric acid, sulphuric acid, phosphoric acid or boric acid; and examples of organic acids are: acetic acid, oxalic acid, malonic acid and citric acid. Particularly good permanent effects are obtained with o-phosphoric acid.

As a further component according to (d), the aqueous solution or dispersion can contain, e.g. an antimicrobic agent, especially one of the following formulae:

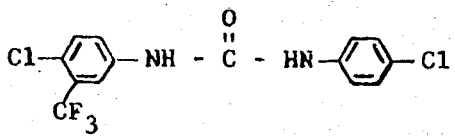

;

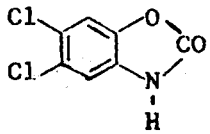

;

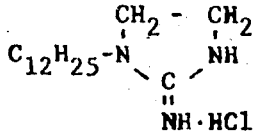

;

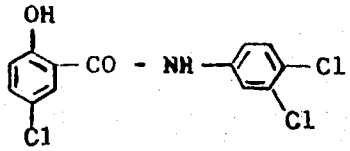

;

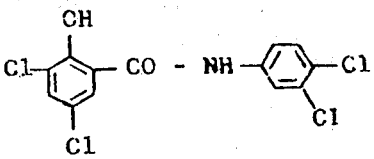

;

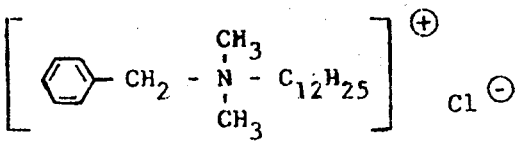

;

or particularly:

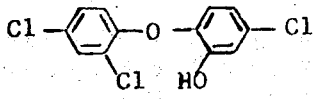

Finally, it is possible to add to the aqueous preparation, as further components, solubility-promoting agents such as, e.g. oleic acid, as well as commercial anti-foam agents, which suppress the foam-formation of the dissolved combination in water, such as, e.g. silicone compounds.

Particularly favourable results are obtained by application from an aqueous solution or dispersion, in the process according to the invention, of 0.2 to 2% each of the components (a) and (b), together with 0.04 to 0.4% of the component (c), relative to the weight of the material to be treated.

Exceptionally favourable results are obtained, with regard to permanent effects, if the process according to the invention is performed with a pH-value of the solution of 2 to 5.

The aformementioned components (a) to (d) are known as per se, and can be produced by methods known per se.

Suitable fibre material to be treated according to the invention is, in particular, organic natural fibre material, and especially organic synthetic fibre material. Examples of natural fibre materials are: wool, silk, cotton and jute; and of synthetic fibre materials: regenerated cellulose, acetate rayon, polyamide, polyester, polyacrylonitrile, polyolefins or mixed fabrics, e.g. made from polyamide/polyester or cellulose/Polyamide. With regard to these materials, they can be undyed or preferably dyed materials. The materials are advantageously in the form of flock, yarn or piece-goods, such as floor-coverings, for example, carpets, or in the form of other household textiles, such as furniture coverings, curtains, or wall-coverings.

The finishing according to the invention of the fibre material is performed by application of the said components to the fibre material preferably by spraying, impregnating, slop-padding, or by means of the exhaust process, optionally also by brushing.

Advantageously, the mixture of components according to the invention is evenly sprayed as an aqueous dispersion (sraying liquor), by means of spraying equipment, on to the wet or dry material to be treated, the amount applied being such that, after the drying of the material at 100° to 180°C, sufficient of the component mixture remains on the surface of the material to ensure that the desired permanent effects are obtained.

The materials treated according to the invention carry no electrical charge for a very long time, i.e. there occur no disturbing discharges on contact or when the treated material is being walked on. In the case of dyed materials, moreovér, the fastness to rubbing is not appreciably affected or the fastness to light impaired.

The fibre material finished according to the invention can be repeatedly dry brushed, vacuum cleaned or shampooed without the imparted twofold or threefold finishing effect being lost. The permanence of the obtained effects can be verified by means of a walking test.

For the preparation of suitable aqueous solutions or dispersions for the finishing process according to the invention, it is also possible to use premixed aqueous preparations made up essentially as follows:

a. 10 to 20, and preferably 14 to 16, per cent by weight of at least one antistatic agent, b. 3 to 35, and preferably 10 to 20, per cent by weight of a stabilised, especially 40%, aqueous, non-film-forming dispersion of polystyrene or of a styrene copolymerisate, c. 1 to 6 per cent by weight of at least one acid, and d. 0 to 5 per cent by weight of further constituents.

Finishing liquors usable according to the invention are produced from such preparations by dilution of 3 to 250 g of these preparations with water, and optionally thickener-solution, to give 1 liter, the degree of dilution depending on the desired finishing effects.

The employment of such preparations for the production of finishing liquors according to the invention has the important advantage that the preparations are easy to handle, and that the finishing agent is generally in solution, or in an extremely finely dispersed form and, in particular, in a homogeneous form, by virtue of which very uniform finishing effects are achieved.

Finally, the mixture of components (a) to (d) according to the invention can also be mixed together to obtain a powder, which is dusted in this form on to the initial mentioned fibre material and fixed by a heat treatment of about 100° to 180°C.

The following examples serve to further illustrate the invention, but this is not limited to the given examples. The temperatures are expressed in degrees Centigrade.

EXAMPLE 1

A polyamide carpet (pile weight 800 g/m²) having a width of 4.20 m and dyed blue, in a known manner, with the dyestuff of the formula:

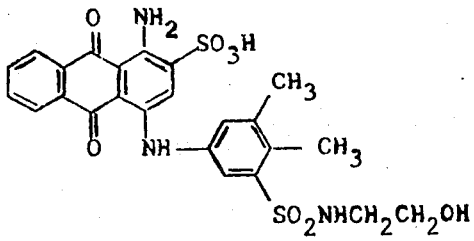

is passed over a roller at a rate of 1.9 m/minute. Horizontally over the roller is arranged, at a distance of ca. 10 cm, a spraying-bar provided with nozzles spaced about 30 cm. apart. Under a pressure of ca. 3 atm., an aqueous dispersion containing 41.5 g/l of the subsequently described preparation (= 450 ml of aqueous dispersion/minute/nozzle) is sprayed from these nozzles on to the moving polyamide carpet. The polyamide carpet is afterwards dried at 140° on a stretching-frame. In this manner is obtained a polyamide carpet having a permanent antistatic, dirt-repellent and antimicrobial finish, these valuable properties being retained by the carpet even after extensive wear due to walking, brushing and vacuum cleaning.

A comparison of the thus treated carpet with a polyamide carpet not finished according to the invention reveals the following differences:

| | Finished | Not Finished |
|---|---|---|
| Charge carried | 100 volts | >3000 volts |
| Staining | slight | severe |
| Fastness to rubbing | excellent | poor |
| Retention of properties after being walked on 10,000 times (permanence) | excellent | poor |

The liquid preparation used in this example can be obtained, for example, as follows:

An amount of 160 g of salt-free water is placed in a flask, and additions are then made, with stirring, of 1.86 g of a polyglycol ether of the formula:

$$C_{18}H_{37}-O(CH_2CH_2O)_{18}H$$

and 80 g of a fatty acid amide of the formula:

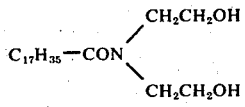

By slow heating of the mixture of about 60°, a homogeneous pase is obtained; to this are subsequently added. 0.67 g of a polyglycol ether of the formula:

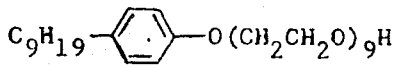

and 7.25 g of 80% acetic acid. Stirring is continued at 60° for a further 30 minutes, and the reaction mixture then allowed to cool to a temperature of about 30°, whereupon 42 g of 80% o-phosphoric acid, dissolved in 143.22 ml of water, are stirred in.

In a separate vessel, 10 g of the antimicrobial compound of the formula:

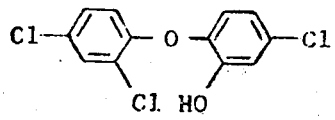

15 g of polyglycol ether of the formula:

$$C_{18}H_{37}-O-(CH_2CH_2O)_{18}H$$

and 6 g of commercial oleic acid are melted together, with stirring, at a temperature of 80°; to the clear melt are then added at 30° 69 g of water free from salt. The obtained solution is thereupon stirred into the above described paste, whereby the reaction mixture becomes fluid. As soon as a stirrable paste is obtained, additions are carefully made to the reaction mixture of 53.5 g of the compound of the formula:

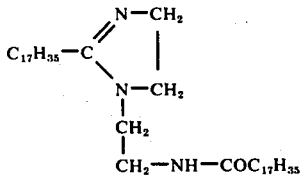

dissolved in 251.85 g of water free from salt, and 8.65 g of 80% acetic acid, 1 g of a 15% aqueous silicone-emulsion and 150 g of a 40% aqueous polystyrene emulsion. Stirring is then continued for ca. 60 minutes, and a liquid preparation directly ready for use is obtained.

If, instead of the blue-dyed polyamide carpet mentioned in the example, a polyester carpet dyed orange, in a known manner, with the dyestuff of the formula:

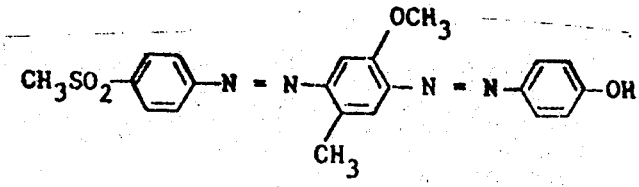

or a polyacrylonitrile carpet dyed bright red with the dyestuff mixture of the formulae:

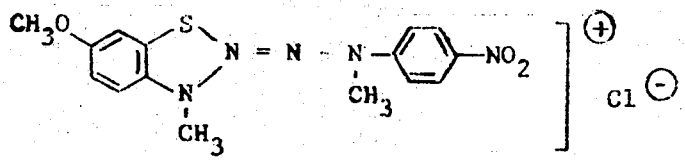

and

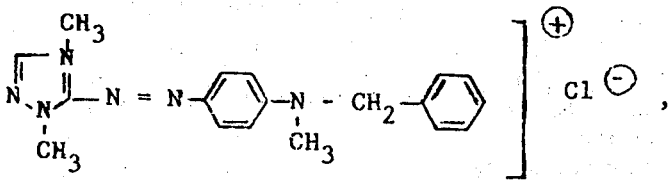

is used, the procedure being otherwise according to the data given in Example 1, then equally well finished carpets are obtained.

EXAMPLE 2

An aqueous impregnating liquor containing 60 g/l of the liquid preparation obtained according to Example 1 is used to impregnate, at a temperature of about 20° to 30°, a polyamide fabric dyed yellowish-red, in a known manner, with the dyestuff of the formula:

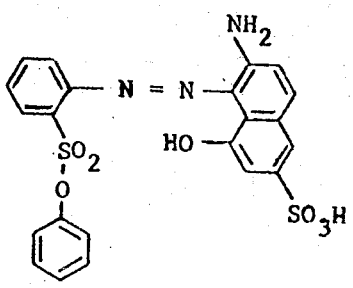

the fabric is subsequently squeezed out to 100% relative to the dry weight of the material, and then dried at 140° for 5 minutes. The polyamide fabric thus obtained is fast to rubbing and possesses an excellent antistatic, dirt-repellent and antimicrobial finish, the said fabric being capable of retaining its valuable properties for a very long period of time, even after repeated dry brushing and shampooing.

If, instead of the yellowish-red dyed polyamide fabric, a correspondingly dyed Helanca- article is used, or one such article dyed yellow, in a known manner, with the dyestuff of the formula:

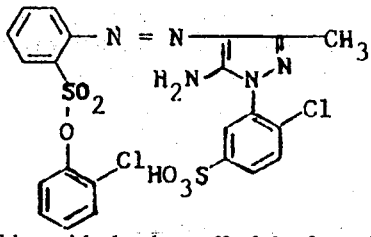

or dyed blue with the dyestuff of the formula:

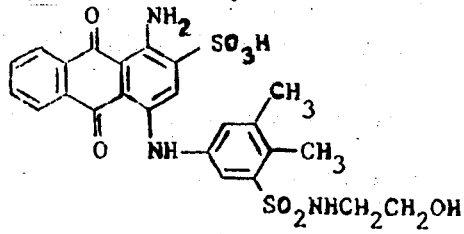

with otherwise the same procedure as that described in the example, then a Helanca-article is obtained possessing similarly good finishing effects.

If in this example is used, instead of the liquid preparation according to Example 1, an impregnating liquor obtained by the dissolving of 6.0 g of a compound of the formula:

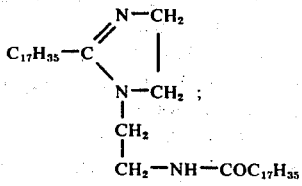

6.0 g of polystyrene emulsion (40%), and 1.7 g of 80% o-phosphoric acid in one liter of water, the procedure being otherwise the same as that given in Example 2, then a Helanca piece-article is obtained possessing a finish just as permanently antistatic and dirt-repellent, the dyeings of which have excellent fastness to rubbing.

If, instead of the last-mentioned preparation, an impregnating liquor is used obtained by the dissolving in one liter of water of 2.1 g of a compound of the formula:

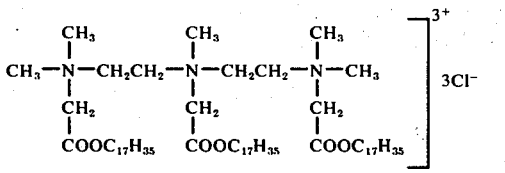

3.9 g of a compound of the formula:

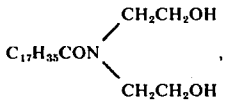

6.0 g of polystyrene emulsion (40%) and 1.7 g of 80% o-phosphoric acid, with the procedure otherwise as given in the above example, then a dyed Helanca piece-article is obtained having fastness to rubbing and displaying excellent antistatic and dirt-repellent effects.

A Helanca piece-article exhibiting similarly good finishing effects is obtained using the procedure described in Example 2, but employing, instead of the stated impregnating liquor, an impregnating liquor obtained by the dissolving of 2.1 g of a compound of the formula:

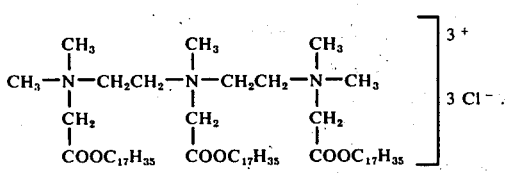

3.2 g of a compound of the formula:

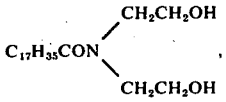

0.8 g of a compound of the formula:

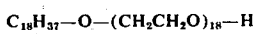

6.0 g of 40% polystyrene emulsion and 1.7 g of 80% o-phosphoric acid in one liter of water.

Finally, if an impregnating liquor is employed which is obtained by the dissolving of 15 g of a polyglycol ether having a molecular weight of 300 to 500, 15 g of 40% polystyrene emulsion and 4.5 g of 80% o-phosphoric acid in one liter of water, with the procedure otherwise as described in the example, then a yellow, red, or blue dyed Helanca piece-article is obtained exhibiting good dirt-repellent and antistatic effects, the dyeings thereof having very good fastness to rubbing.

EXAMPLE 3

To a trough containing a slop-padding roller is added an aqueous solution consisting of 200 kg of the liquid preparation described below dissolved in 1000 liters of water.

A polyamide carpet (pile weight 400 g/m²) 5 meters in width, dyed according to Example 1, passes over this trough at a rate of 5 m/minute. By means of the rotating padding-roller, the slop-padding liquid is padded on to the moving polyamide carpet. Liquor-pick-up 20% relative to the weight of the pile. Drying is subsequently carried out on a stretching-frame for 7 minutes at 170°, In this way is obtained a polyamide carpet possessing an excellent antistatic and dirt-repellent finish, and which retains its valuable finish-properties for a very long period of time, even after being repeatedly walked on, brushed and shampooed.

The preparation used in Example 3 is obtained, for example, by the placing into a flask of 160 g of water free from salt and the addition to this, with stirring, of 1.86 g of polyglycol ether of the formula:

and 80 g of fatty acid amide of the formula:

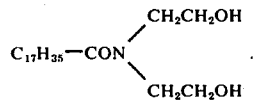

With slow heating to about 60°, a homogeneous paste is obtained, to which are then added 0.67 g of polyglycol ether of the formula:

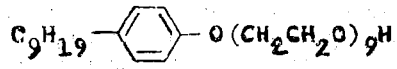

and 7.25 g of 80% acetic acid. Stirring is carried out at 60° for a further 30 minutes; the reaction mixture is subsequently allowed to cool to a temperature of about 30°, whereupon 42 g of 80% o-phosphoric acid dissolved in 143.22 ml of water free from salt are stirred in. An addition is then carefully made to this paste of 53.5 g of a compound of the formula:

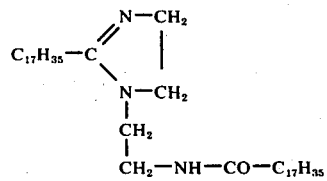

dissolved in 251.85 g of water free from salt, and 8.65 g of 80% acetic acid, 150 g of a 40% polystyrene emulsion, 1 g of a 15% silicone-emulsion and 100 g of water free from salt. After 1 hour's stirring, a liquid preparation is obtained directly ready for use.

EXAMPLE 4

A polyamide carpet dyed blue according to Example 1 is passed, in a winch vat, through an aqueous liquor (1:40) containing 3 g/l of a liquid product obtained according to Example 1, but which contains, instead of 42 g of 80% o-phosphoric acid dissolved in 143.22 ml of water, 109 g of hydrochloric acid (36%) dissolved in 76.22 g of water, the liquor temperature being 45° and the treatment time 15 minutes. The thus treated polyamide carpet is subsequently dried for 7 minutes at 140°. A blue-dyed polyamide carpet is obtained which possesses an excellent antistatic, dirt-repellent and antimicrobial finish, and which retains its valuable finish-properties for a very long period of time, even after being repeatedly walked on, brushed and shampooed.

If a preparation produced according to Example 1 is employed, but which contains, instead of the total amount of 557.07 g of water free from salt, the amount given in Table I, Column II, and instead of 109 g of 36% hydrochloric acid, the amount of acid or acid mixture shown in Column III of the table, then liquid preparations are obtained having the pH-values given in Column IV, which, when applied, for example, to polyamide fabric by application of the process according to Example 4, produce good antistatic, dirt-repellent and antimicrobial finish-effects with good fastness to rubbing.

TABLE I

| I | II | III | IV |
|---|---|---|---|
| Example No. | Water free from salt (g) | Acid g | pH-value of the product |
| 5 | 612.07 | 54.0 sulphuric acid 98% | 2.0 |
| 6 | 601.27 | 22.4 boric acid and 42.4 acetic acid 80% | 4.2 |
| 7 | 585.47 | 80.6 acetic acid 80% | 4.1 |
| 8 | 597.47 | 68.6 oxalic acid $2H_2O$ | 2.4 |
| 9 | 592.67 | 73.4 citric acid . $H_2O$ | 3.8 |

Materials possessing a similarly permanent antistatic, dirt-repellent and anti-microbial finish are obtained if, instead of the preparations used in the aforementioned examples, a preparation is employed which is produced as follows, with otherwise the same procedure as described in the previously described examples:

An amount of 160 g of water free from salt is placed into a flask and, whilst stirring is maintained, 1.86 g of a polyglycol ether ($a_1$) and 80 g of a fatty acid amide ($a_2$) are added. With slow heating of this mixture to 60°, a homogeneous paste is obtained, and to this are subsequently added 0.67 g of a polyglycol ether ($a_3$) and 7.25 g of 80% acetic acid. The reaction mixture is stirred at 60° for a further 30 minutes, and the temperature subsequently allowed to fall to 30°, whereupon 42 g of o-phosphoric acid (80%) dissolved in 143.22 ml of water free from salt are stirred in.

In a separate vessel, 10 g of the antimicrobial compound (d) and 15 g of polyglycol ether ($a_1$) and 6 g of commercial oleic acid are melted together, with stirring, at a temperature of about 80°; and to the clear melt are then added 69 g of water free from salt at ca. 30°. The obtained mixture is thereupon stirred into the paste contained in the flask. The mixture is further stirred, and to it are carefully added 53.5 g of a compound ($a_4$) dissolved in 251.85 ml of water free from salt and 8.65 g of 80% acetic acid, 1 g of a 15% silicone-emulsion and 150 g of a 40% polystyrene emulsion. Stirring is continued for about 60 minutes, and a liquid preparation is obtained directly ready for use.

EXAMPLE 10

Polyglycol ether ($a_1$)

$C_{18}H_{37}-O-(CH_2CH_2O)_{30}-H$ acid amide ($a_2$)

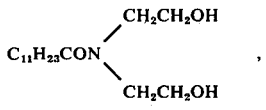

polyglycol ether ($a_3$)

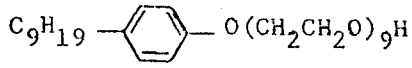

antimicrobic agent (d)

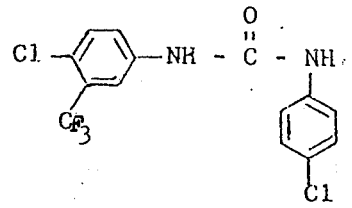

antistatic agent ($a_4$)

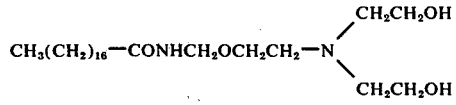

EXAMPLE 11

Polyglycol ether ($a_1$)

$C_{16}H_{37}-O-(CH_2CH_2O)_{16}H$ acid amide ($a_2$)

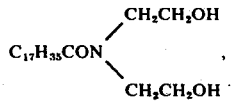

polyglycol ether ($a_3$)

$C_{17}H_{35}-O-(CH_2CH_2O)_{30}-H$ antimicrobic agent (d)

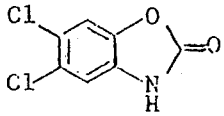

antistatic agent ($a_4$)

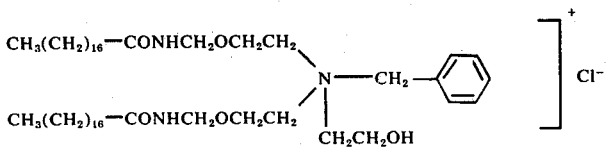

EXAMPLE 12

Polyglycol ether ($a_1$)

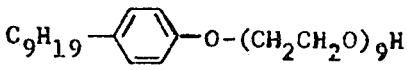

acid amide ($a_2$)

mixture of $C_{17}H_{35}CONHCH_2CH_2OH$ and

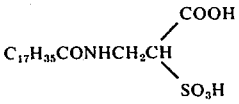

polyglycol ether ($a_3$)

$C_{18}H_{37}—O—(CH_2CH_2O)_{18}H$ antimicrobic agent (d)

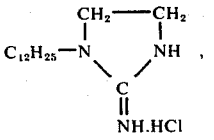

antistatic agent ($a_4$)

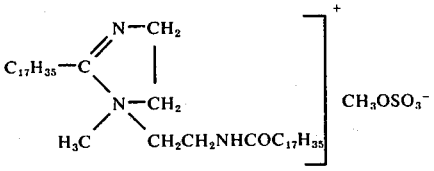

EXAMPLE 13

Polyglycol ether ($a_1$)

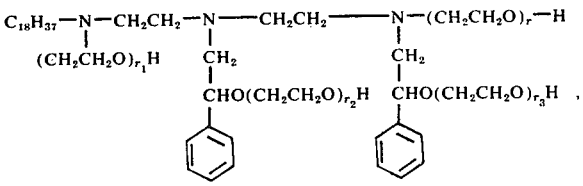

$r, r_1, r_2, r_3$ = ca. 100 Mol AeO acid amide ($a_2$)

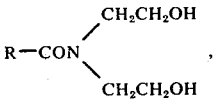

$R = C_nH_{2n+1}$
$n = 8 - 21$ polyglycol ether ($a_3$)

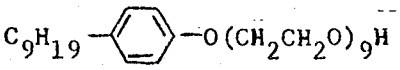

antimicrobic agent (d)

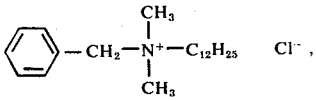

antistatic agent ($a_4$)

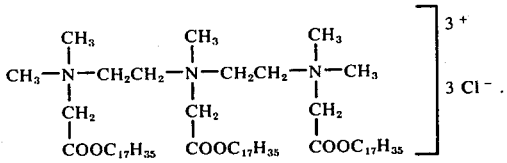

EXAMPLE 14

Wool carpet yarn, dyed brown and subsequently dried in the known manner with application of the suspension system, is passed in a width of ca. 80 cm, on a conveyor belt, with a speed of ca. 1.1 m/min under the spraying-beam described in Example 1. An aqueous dispersion containing 60 g/l of the preparation described in Example 1 (= 600 ml of aqueous dispersion/-nozzle/minute) is sprayed from the aforementioned nozzles under a pressure of 4 atm. on to the moving carpet yarn. The yarn is afterwards squeezed out on a padding machine to obtain a residual moisture content of 50%, and dried over a drum at ca. 100°–120°C. After this finishing process, there is present on 1 kg of wool carpet yarn an amount of 30 g of the preparation described in Example 1.

Wet, as well as dry, wool carpet yarn can be finished by application of the described process; in the case of the wet material, however, 75 g/l of the preparation described in Example 1 are to be used.

It is also possible to treat, in place of wool carpet yarn, a wool/polyamide yarn: mixture ratio, e.g. 80% Wool : 20% polyamide.

The described finishing process enables wool carpet yarn to be obtained having a permanent anti-electrostatic dirt-repellent and antimicrobial finish, these valuable properties being retained by the thus treated material even after being repeatedly walked on, brushed and cleaned by suction.

The finished yarn is used for the manufacture of carpets.

A comparison of a polyamide carpet finished according to the invention with a polyamide carpet not finished in that manner shows the following differences:

| | Finished | Not finished |
|---|---|---|
| Charge carried | 300 volt | volt |
| Staining | slight | severe |
| Retention of finish after being walked on 10,000 times | very good | bad |

EXAMPLE 15

A polyamide knitted fabric (with a width of ca. 42 cm and a weight of ca. 500 g/m²), printed, steamed and rinsed in the usual manner, is squeezed out on a padding machine to effect removal to a great extent of the water contained; the material is subsequently passed over a roller at a rate of 10 m/min.. A spraying-beam is mounted horizontally over the roller at a distance of ca. 10 cm, the nozzles on the beam being ca. 30 cm apart. An aqueous dispersion containing 125 g/l of the preparation described in Example 1 (= 600 ml of aqueous dispersion/nozzle/minute) is sprayed under a pressure of 4 atm. on to the moving polyamide knitted fabric. The knitted fabric is subsequently dried, e.g. on a Fleissner drum-drier apparatus at ca. 120°C, opened out and rinsed. The rinsed knitted yarn is used for the manufacture of carpets. In order to achieve a better untilisation of the plant, it is possible in this finishing process to have several tracks of polyamide knitted fabric running side by side.

The described finishing operation enables polyamide knitted fabrics to be obtained having a permanent anti-electrostatic, dirt-repellent and antimicrobial finish, these valuable properties being retained even after the thus treated material has been repeatedly walked on, brushed and suction cleaned.

A comparison of the polyamide material finished according to the invention with a polyamide carpet not finished in this manner shows the following differences in characteristics:

| | Finished | Not finished |
|---|---|---|
| Charge carried | 0 volt | 4500 volts |

-continued

| | Finished | Not finished |
|---|---|---|
| Staining | slight | severe |
| Retention of finish after being walked on 10,000 times | excellent | poor |
| Manufacture of carpet (tufting) | better than usual | as usual |
| Retention of the structure after being walked on 10,000 times | much better than usual | as usual |

We claim:

1. A preparation for use in giving fiber materials a permanent antistatic and dirt-repellent finish, consisting essentially of an aqueous dispersion of a. 10 to 20% by weight of an antistatic agent comprising a compound of the formula

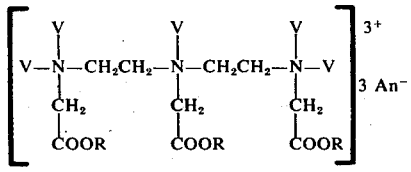

wherein

V represents a lower alkyl radical,

R represents an alkyl radical having 8 to 22 carbon atoms, and $An^-$ represents an anion, b. 3 to 35% by weight of an aqueous non-film-forming dispersion of polystyrene, c. 1 to 6% by weight of an inorganic or organic monobasic or polybasic acid and d. 0 to 5% by weight of an antimicrobic agent.

2. The preparation of claim 1, wherein the antistatic agent is a compound of the formula

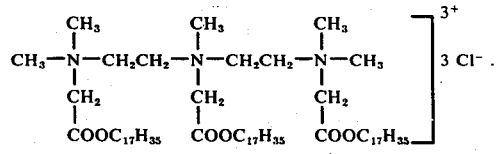

3. The preparation of claim 2, wherein the antistatic agent further comprises a compound of the formula

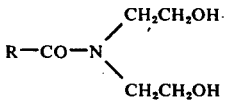

wherein R is alkyl of 8 to 22 carbon atoms.

4. The preparation of claim 3, wherein R is heptadecyl.

5. The preparation of claim 1, wherein the antistatic agent further comprises a polyglycol ether of the formula $$Z-(CH_2CH_2O)_xH$$

wherein Z is the radical of an aliphatic alcohol, aliphatic amine or aliphatic carboxylic acid each having 8 to 22 carbon atoms, or of an alkyl phenol in which the alkyl part has 8 to 12 carbon atoms and $x$ is a whole number in the range 5 to 100.

6. The preparation of claim 2, wherein the antistatic agent further comprises a polyglycol ether of the formula $$C_{18}H_{37}O(CH_2CH_2O)_{18}H$$

or

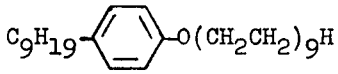

7. The preparation of claim 1, wherein acid component (c) is selected from hydrochloric acid, hydrobromic acid, nitric acid, sulphuric acid, phosphoric acid, boric acid, acetic acid, oxalic acid, malonic acid and citric acid.

8. The preparation of claim 1, wherein the antimicrobic agent is a compound of the formula

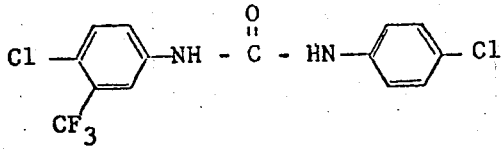

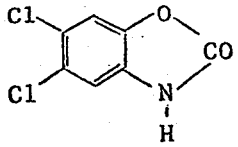

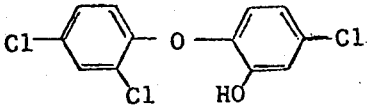

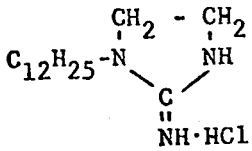

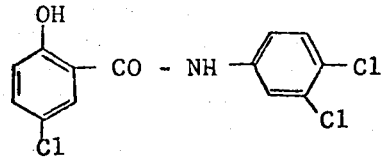

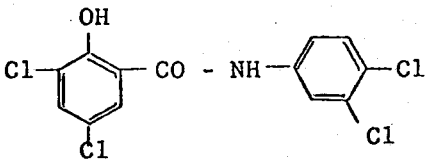

or

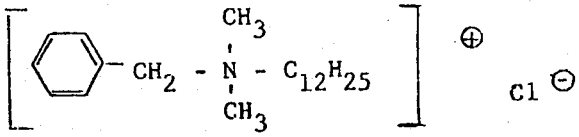

9. A process for imparting a permanent antistatic and dirt repellant finish to fiber materials, comprising the step of applying to the fiber material a composition consisting essentially of an aqueous dispersion of a. 10 to 20% by weight of an antistatic agent comprising a compound of the formula

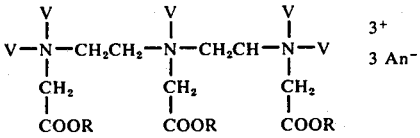

wherein

V represents a lower alkyl radical,

R represents an alkyl radical having 8 to 22 carbon atoms, and An $^-$ represents an anion.

b. 3 to 35% by weight of an aqueous non-film-forming dispersion of polystyrene, c. 1 to 6% by weight of an inorganic or organic monobasic or polybasic acid and d. 0 to 5% by weight of an antimicrobic agent.

* * * * *